US005154220A

United States Patent [19]

Crawford

[11] Patent Number: 5,154,220

[45] Date of Patent: Oct. 13, 1992

[54] METHOD AND APPARATUS FOR MAKING METAL SHOT

[76] Inventor: Tommy N. Crawford, 6562 Christene Blvd., Brook Park, Ohio 44142

[21] Appl. No.: 622,955

[22] Filed: Dec. 6, 1990

[51] Int. Cl.[5] ..... B22D 45/00; B22D 11/01; B29B 9/00

[52] U.S. Cl. ..... 164/270.1; 164/348; 164/76.1; 425/6; 264/9; 75/335

[58] Field of Search ..... 425/6, 10; 164/348, 164/130, 76.1, 270.1, 260, 271; 264/9, 13; 75/335, 340

[56] References Cited

U.S. PATENT DOCUMENTS

| | | | |
|---|---|---|---|
| 2,268,888 | 1/1942 | Mericola | 425/6 |
| 2,583,452 | 1/1952 | Watts | 426/6 |
| 2,978,742 | 4/1961 | Bliemeister | 425/6 |
| 3,010,819 | 11/1961 | Naeser | 425/6 |
| 3,150,212 | 9/1964 | Jacklin | 425/6 |
| 3,208,101 | 9/1965 | Kaiser et al. | 425/6 |
| 3,439,633 | 4/1969 | Pawlak et al. | 425/6 |
| 3,677,669 | 7/1972 | Bliemeister | 425/6 |
| 3,702,748 | 11/1972 | Storb et al. | 425/6 |
| 3,719,732 | 3/1973 | Diffenbach | 264/9 |
| 4,154,379 | 5/1979 | Schermutzki | 264/9 |
| 4,284,393 | 8/1981 | Brunosson | 425/7 |
| 4,461,636 | 7/1984 | Gagneraud | 65/141 |
| 4,995,894 | 2/1991 | Spencer | 425/6 |

FOREIGN PATENT DOCUMENTS

| | | | |
|---|---|---|---|
| 52-25833 | 7/1977 | Japan | 425/6 |
| 301058 | 3/1982 | U.S.S.R. | 425/6 |
| 1517991 | 10/1989 | U.S.S.R. | 425/6 |

*Primary Examiner*—Richard K. Seidel
*Assistant Examiner*—Rex E. Pelto
*Attorney, Agent, or Firm*—Body, Vickers & Daniels

[57] ABSTRACT

Apparatus for producing metal shot includes pans having rows of apertures in the bottom walls thereof, a deflector member for each row of openings vertically underlying the corresponding row of openings and having a planar surface disposed at an angle to horizontal, and an inclined conveyor spaced below the deflector members. The pans and the deflector members and conveyor are vibrated, and the deflector members are cooled. Molten metal is placed in the pans, and vibration of the pans causes the molten metal flow downwardly through the openings therein to be interrupted, whereby droplets fall from the openings onto the corresponding deflector member. The descent of the droplets through air and the impingement of the droplets on the cooled deflector members cool and solidify the droplets. The droplets are somewhat flattened by impingement against the deflector members and are deflected laterally therefrom and fall downwardly onto the conveyor. The flattened droplets are further cooled as they descend downwardly from the deflector members through air and, upon engaging the conveyor, the droplets are further cooled as they are conveyed by the conveyor to a collecting point.

1 Claim, 4 Drawing Sheets

METHOD AND APPARATUS FOR MAKING METAL SHOT

BACKGROUND OF THE INVENTION

This invention relates to the art of making metal shot and, more particularly, to a method and apparatus for making dry metal shot.

The present invention finds particular utility in connection with making aluminum shot for use, for example, in the steel making industry, and accordingly the invention will be disclosed and described in conjunction with making aluminum shot. At the same time, however, it will be appreciated that the invention is applicable to the production of shot from metals other than aluminum and to the production of shot for uses other than in the steel making industry.

It is of course well known to make metal shot by forming droplets of molten metal and allowing the droplets to descend into a receptacle filled with a coolant such as water to solidify the droplets. Such is shown for example in U.S. Pat. No. 194,271 to Shiver, wherein droplets are formed by vibrating a pan into which the molten metal is poured and the bottom wall of which pan is apertured so that droplets of the molten metal are formed as the metal passes through the apertures. The making of metal shot by such direct liquid cooling is undesirable for a number of reasons including the fact that it is difficult to maintain the cooling fluid at a uniform temperature as is necessary to assure a desired quality with respect to the shot being produced. In this respect, if the cooling liquid is too cool the metal of the shot is adversely affected by the shock of sudden cooling, and if the cooling liquid is too warm the shot tends to adhere to each other, whereby clumps of shot are produced rather than individual pieces of shot. Further, the use of cooling liquid requires having to convey the shot to a dryer, and then having to convey the shot to a point of storage or use. The process therefore becomes very time consuming and expensive. Still further, the liquid cooling and drying can result in the oxidation of the surface of the shot which, while not affecting the shot in use, does affect the appearance thereof. Furthermore, the requirement for conveying the cooled shot from the liquid container to equipment for drying the shot increases both the cost of apparatus and the floor space required to accommodate the equipment.

Apparatus has also been provided to produce shot without the use of a cooling liquid. In this respect, for example, U.S. Pat. No. 3,150,212 discloses the forming of shot by dropping molten metal onto a cooled, rotating drum and then onto an inclined chute from which the shot drops into a receptacle containing an anti-oxidizer. The disadvantage of apparatus of this character is the fact that the rate of production is determined by the axial length of the rotating drum whereby, for a given axial length, production can only be increased by increasing the number of drums onto which the shot can fall. Such cooled, rotating drums are not only expensive to manufacture but also to maintain and, because of the rotating and cooled nature thereof, frequent maintenance is necessary. Still further, regardless of whether a number of single roll units where installed to attain a desired production rate, or a multiple roll arrangement were designed, the cost of the apparatus and the cost of maintaining the same would be undesirably high and the apparatus would require an undesirable amount of floor space.

SUMMARY OF THE INVENTION

In accordance with the present invention, a method and apparatus is provided for producing metal shot in a manner which is more economical than heretofore possible with respect to the cost of equipment and the cost of maintenance thereof and which, in a given amount of occupied floor space, enables a higher production rate than can be attained with apparatus heretofore provided for the production of dry shot. More particularly in this respect, metal shot is produced in accordance with the present invention by producing a plurality of rows of molten metal droplets, such as through the use of a vibrating container for molten metal having rows of openings in the bottom wall thereof. Each row of droplets falls vertically from the container through an air space for initial cooling and then impinges on a corresponding deflector member underlying the row of openings and which deflector member interrupts the descent of the droplets. The droplets are somewhat flattened by impingement against the deflector member, and the impingement of the droplets on the deflector member provides a second phase of cooling for the droplets. Preferably, the deflector members are cooled to enhance cooling and solidification of the droplets with minimum vertical descent from the molten metal containers. The deflector members are inclined relative to horizontal, and the cooled and solidified droplets slide laterally therefrom so as to descend vertically downward through a second air space which provides a third stage of cooling of the droplets. Preferably, the deflector members are vibrated to enhance control of the time shot remains thereon in conjunction with the angle of incline of the deflector members and the rate of descent of droplets from the molten metal container.

The droplets fall through the second air space onto an underlying conveyor having a discharge end at which the formed shot is collected or transported away from the apparatus. The conveyor provides a fourth stage of cooling within the confines of the apparatus in that the shot is further cooled as it moves towards the discharge end of the conveyor. Preferably, the conveyor is a vibratory conveyor having an inclined planar surface along which movement of the shot is promoted by the vibration of the conveyor, such a conveyor being preferred from the standpoint of production cost and maintenance considerations.

Further in accordance with a preferred embodiment, the molten metal container or containers have a plurality of rows of openings extending in the direction between the sides of the container and spaced apart in the direction between the upper and lower ends of the inclined conveyor, whereby droplets descending onto the conveyor toward the upper end thereof have a shorter path of descent than do the droplets falling onto the conveyor toward the lower end thereof. Accordingly, the vertical air cooling paths toward the upper end of the conveyor provides for shot contacting the conveyor towards the upper end thereof to be at a higher temperature than that towards the lower end thereof because of the longer air cooling path for the latter. However, as the shot moves along the conveyor towards the discharge end thereof, the shot descending onto the conveyor at the upper end thereof has a longer path of movement along the conveyor than the shot contacting the conveyor towards the lower end thereof, whereby all of the shot is at substantially the same temperature when it reaches the discharge end of the conveyor.

From the foregoing description, it will be appreciated that a considerable number of rows of openings can be provided in a relatively short space in the direction of the conveyor and that each of the rows can be of considerable width in the direction between the sides of the conveyor, whereby for a given horizontal area of floor space the production rate in pounds per hour of shot is optimized using equipment which is structurally simple and economical to produce and maintain.

It is accordingly an outstanding object of the present invention to provide an improved method and apparatus for producing dry metal shot.

Another object is the provision of apparatus for producing dry shot and by which droplets of molten metal are subjected to four distinct cooling phases to assure the cooling and solidification of the shot prior to its discharge from the apparatus.

Yet another object is the provision of apparatus of the foregoing character wherein droplets of molten metal are initially cooled during descent along a vertical path through air, are further cooled by impingement against deflector members which interrupt the descent of the droplets and alter the path of descent thereof such that the droplets further descent along a second vertical path through air during which they are further cooled and following which the droplets engage a conveyor for movement along a conveyor path during which the droplets are further cooled prior to discharge from the conveyor.

A further object is the provision of apparatus of the foregoing character wherein dry metal shot is produced by dropping molten metal droplets against inclined, cooled deflector members and thence onto an inclined conveyor, thus to optimize the cooling of the droplets between the forming thereof and the discharge thereof from the conveyor in a minimum amount of required floor space.

Still a further object of the invention is the provision of apparatus of the foregoing character which is structurally simple, economic to produce and maintain, efficient in operation and by which a high production rate in pounds per hour of shot can be obtained with a minimum requirement for floor space for the apparatus.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF THE PREFERRED EMBODIMENT

Figure 1:
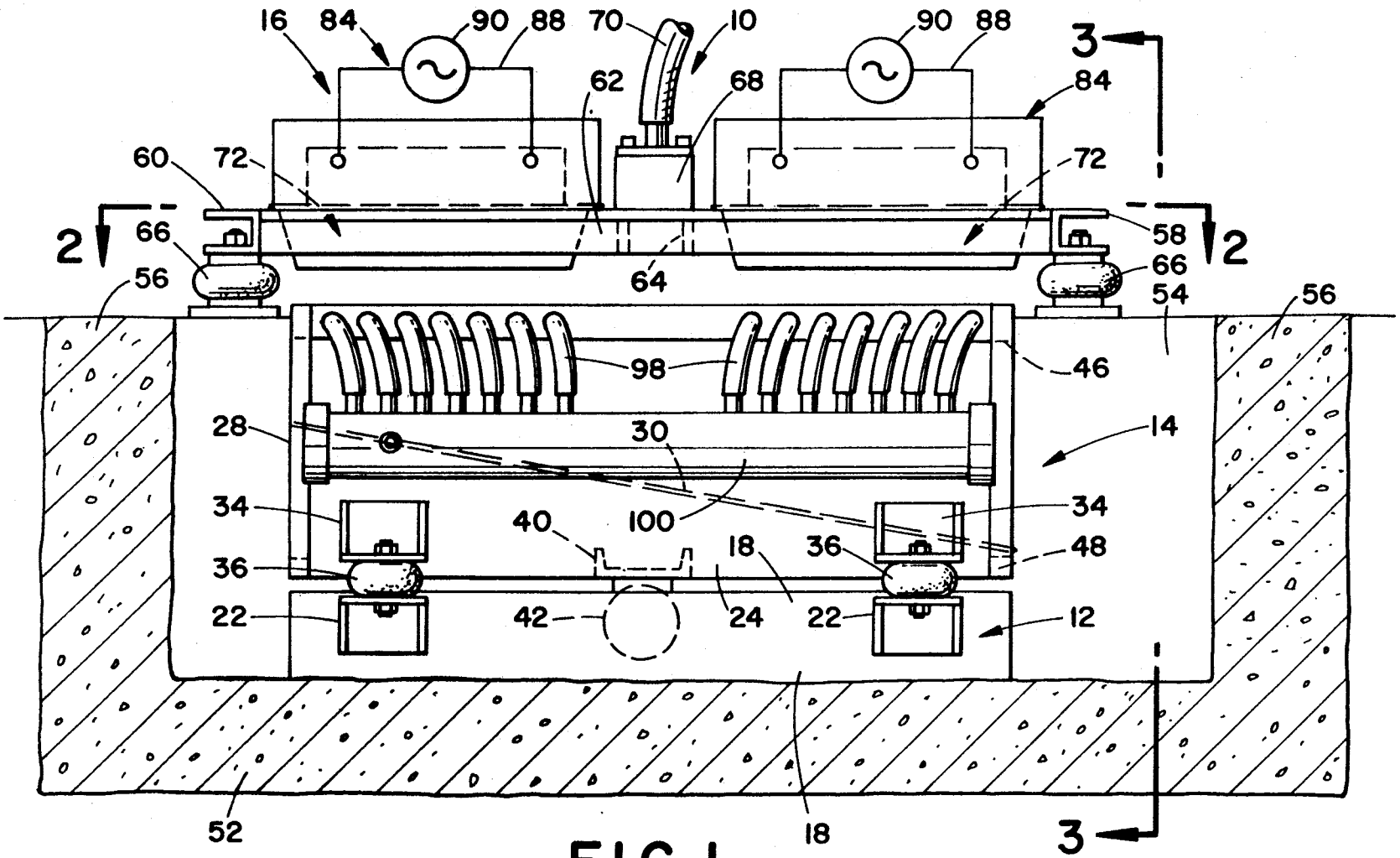
FIG. 1 is a side elevation view, partially in section, of apparatus in accordance with the present invention.

With reference now to the drawing, wherein the showings are for the purpose of illustrating a preferred embodiment of the invention only, and not for the purpose of limiting the invention, apparatus 10 for making aluminum shot in accordance with the present invention is shown in FIGS. 1-4 of the drawing. The shot making apparatus includes a base 12, a deflector and conveyor portion 14 thereabove, and an upper vibrating pan assembly 16. Base 12 is comprised of a pair of longitudinally extending beams 18 laterally spaced apart and interconnected by cross beams 20. Base 12 supports deflector and conveyor portion 14 for vibratory displacement relative thereto and, for this purpose, the laterally outer sides of beams 18 are provided with laterally outwardly extending support brackets 22. Deflector and conveyor portion 14 is of box-like structure and includes laterally spaced apart sheet metal side walls 24 and 26, a sheet metal rear end wall 28 and an inclined sheet metal bottom wall 30. As will become apparent hereinafter, bottom wall 30 provides a conveying surface and, for this purpose, is inclined downwardly from rear wall 28 and has a lower discharge end 32 adjacent the front ends of side walls 24 and 26. The outer sides of side walls 24 and 26 are provided with laterally outwardly extending support brackets 34, each overlying a corresponding one of the support brackets 22 on beams 18, and resilient air bags 36 are interposed between corresponding pairs of the brackets 22 and 34 to support deflector and conveyor portion 14 for vibratory displacement relative to base 12. Support members 38 extend longitudinally along the lower edges of side walls 24 and 26, and a channel-shaped support member 40 extends laterally between members 38 intermediate the longitudinally opposite ends thereof. An electrically driven horizontally oscillating vibrator 42 is mounted on support member 40 to vibrate deflector and conveyor portion 14 relative to base 12 for the purpose set forth hereinafter. Vibrator 42 includes a conductor 44 by which the vibrator is adapted to be connected to a power source, not shown. The frame components for the deflector and conveyor portion 14 further include upper frame members 46 extending along the longitudinal upper edges of side walls 24 and 26, and laterally extending upper and lower frame members 48 and 50 at the front or discharge end of the conveyor.

In the embodiment disclosed, base 12 and deflector and conveyor portion 14 of the apparatus are supported in a concrete pit having a bottom wall 52, laterally spaced apart side walls 54 and end walls 56, and vibratory pan assembly 16 is supported above deflector and conveyor portion 14 on side walls 54 of the pit and for vibratory displacement relative thereto and to the deflector and conveyor portion. More particularly in this respect, the vibratory pan assembly includes a supporting frame structure comprised of laterally extending front and rear frame members 58 and 60, respectively, longitudinally extending frame members 62 having their opposite ends suitably connected to members 58 and 60, such as by welding, and a laterally extending frame member 64 generally centrally between members 58 and 60 and having its opposite ends welded or otherwise secured to members 62. The opposite ends of front and rear frame members 58 and 60 overlie side walls 54 of the concrete pit, and resilient air bags 66 are interposed therebetween to support the vibratory pan assembly for vibration relative to the pit. In the embodiment shown, frame member 64 of the vibratory pan assembly supports an air driven vibrating mechanism 68 having a hose 70 connected to a suitable source of air under pressure, not shown. As is well known, such an air operated vibrating mechanism provides a linear vibratory motion which, in the embodiment shown, is vertical.

Figure 2:
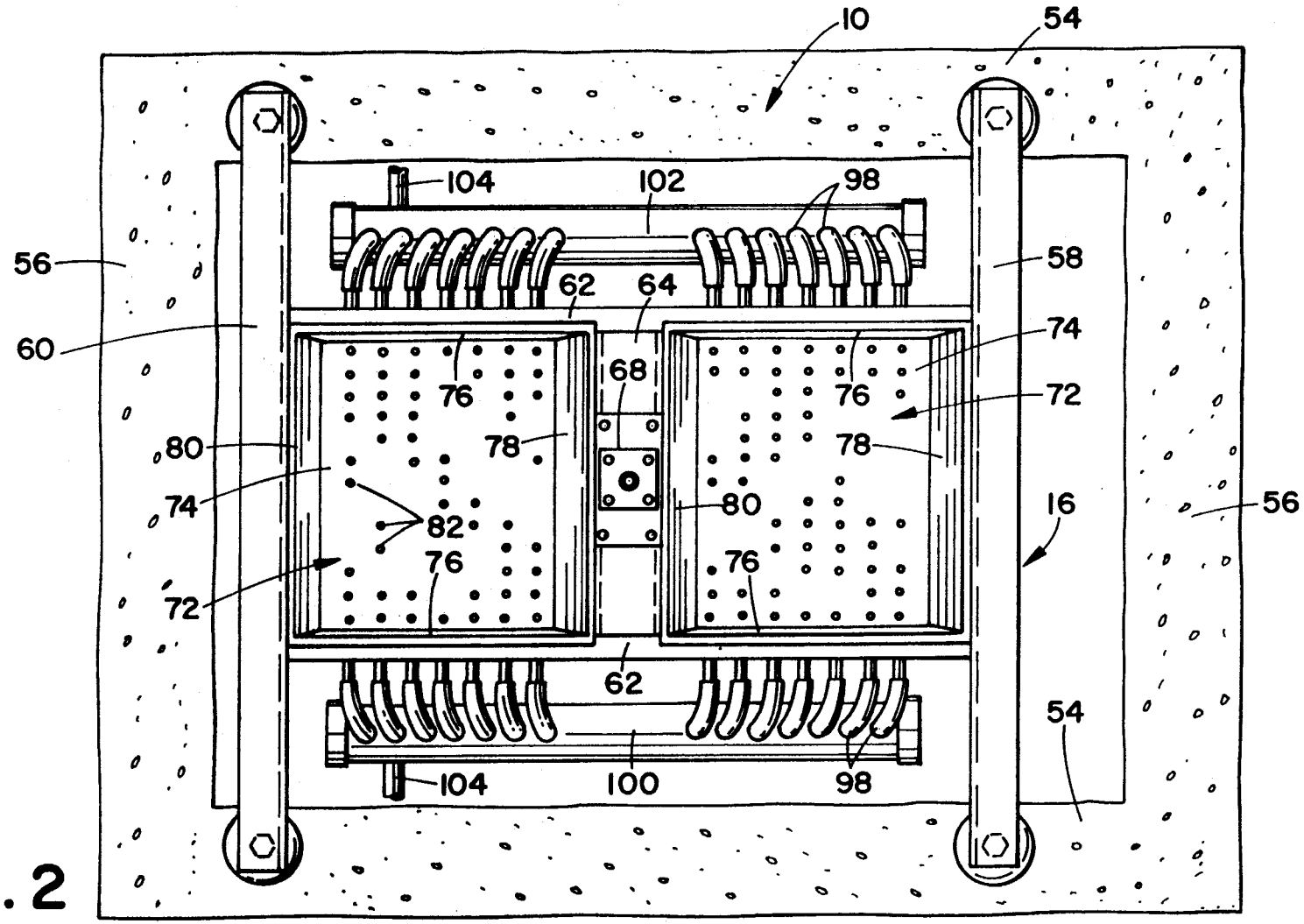
FIG. 2 is a plan view of the apparatus as seen along line 2—2 in FIG. 1.

The vibratory pan assembly further includes a pair of cast iron pans 72 which, in connection with the orientation shown in FIGS. 1–4 of the drawing, have a bottom wall 74, laterally spaced apart side walls 76 and longitudinally spaced apart front and rear walls 78 and 80, respectively. The bottom wall of each pan is provided with a plurality of openings 82 therethrough and, as best seen in FIG. 2, openings 82 are provided in linear rows extending across the pan between sides 76 and are spaced apart in the direction between front and rear walls 78 and 80 of the pan. Pans 72 are removably supported in openings therefor defined by frame members 58, 60, 62 and 64 and, preferably, the pans are heated during operation of the apparatus so as to maintain the molten metal in the pans at a constant temperature. Preferably for this purpose, the pans are covered by a corresponding hood 84 of ceramic fiber material provided on the inner side thereof with corresponding electric heating elements 86 having ends 88 extending outwardly of the hood and connected to a suitable power source 90 as shown schematically in FIGS. 1 and 4. Hoods 84 rest on the frame members and thus are removable to facilitate access to the pans for feeding molten metal thereinto during operation of the machine.

Deflector and conveyor assembly 14 further includes a plurality of deflector members 92 underlying pans 72 and extending in the direction between side walls 76 of the pans. Each deflector member 92 underlies a row of the openings 82 in the corresponding pan, and each of the deflector members has a corresponding upper deflecting surface 94 which, preferably, is planar and inclined downwardly relative to horizontal with respect to the direction from end wall 28 towards the discharge end 32 of conveyor surface 30. Preferably, deflector members 92 are tubular elements having a rectangular cross-sectional configuration and having their opposite ends provided with tubular couplings 96 extending through frame members 46. Hoses 98 connect the outer ends of couplings 96 in flow communication with a corresponding one of a pair of manifolds 100 and 102 to facilitate the circulation of a coolant through the deflector members. In this respect, for example, the ends of manifolds 100 and 102 are closed and the manifolds are connected such as by means of a corresponding line 104 to a source of coolant, not shown. Connection to the source is such that one of the manifolds provides a supply path to the deflectors and the other a return path for the flow of coolant back to the source. Manifolds 100 and 102 are supported on the side walls 24 and 26 such as by support brackets 106. It will be appreciated that the axis of the tubular deflector members 92 lie in a horizontal plane spaced below and parallel to the bottom walls 74 of pans 72 and that the number of deflector members corresponds to the number of rows of openings 82 in the pans.

Figures 3, 5:
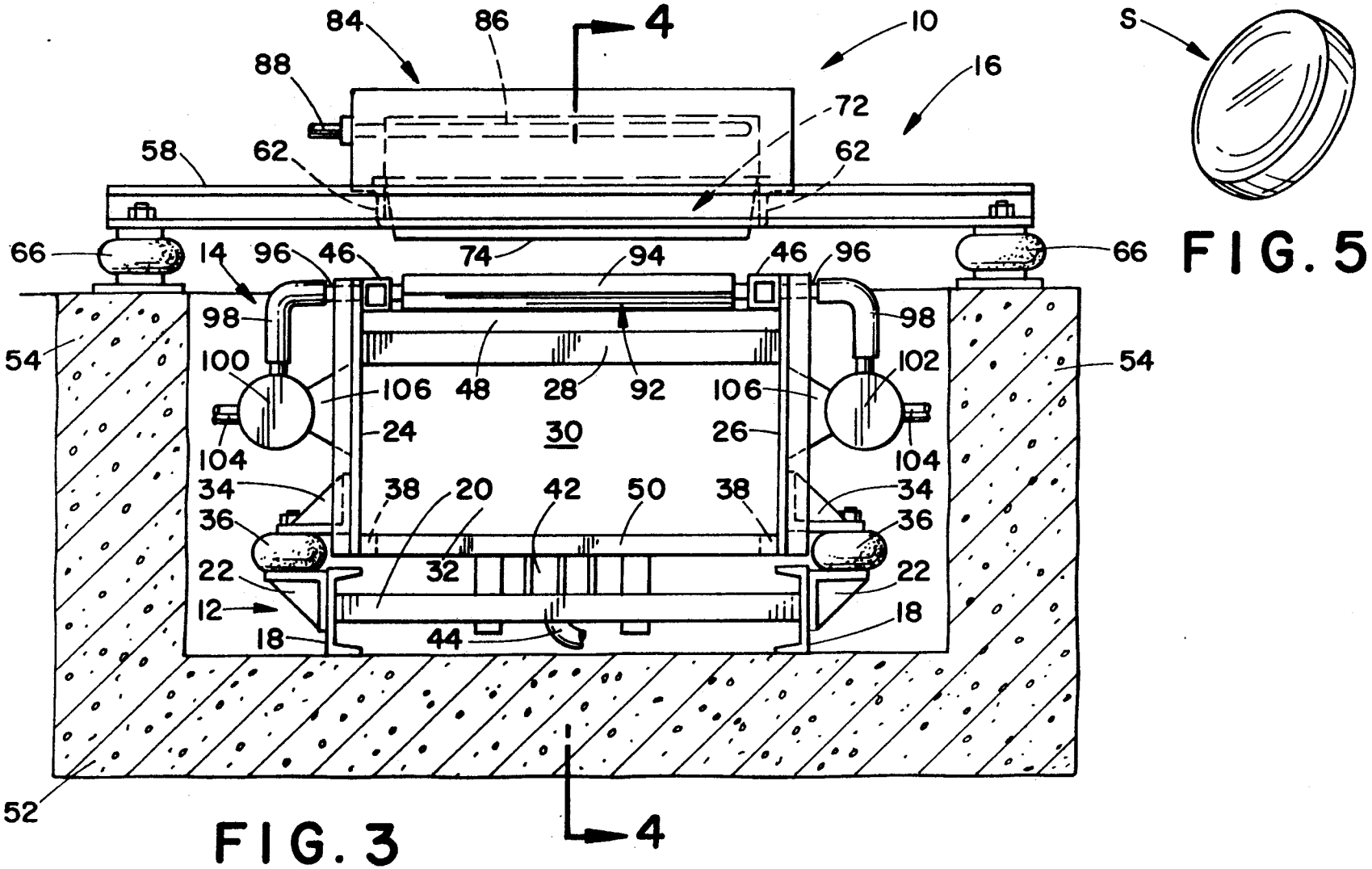
FIG. 3 is an end elevation view of the apparatus as seen along line 3—3 in FIG. 1.
Figure 4:
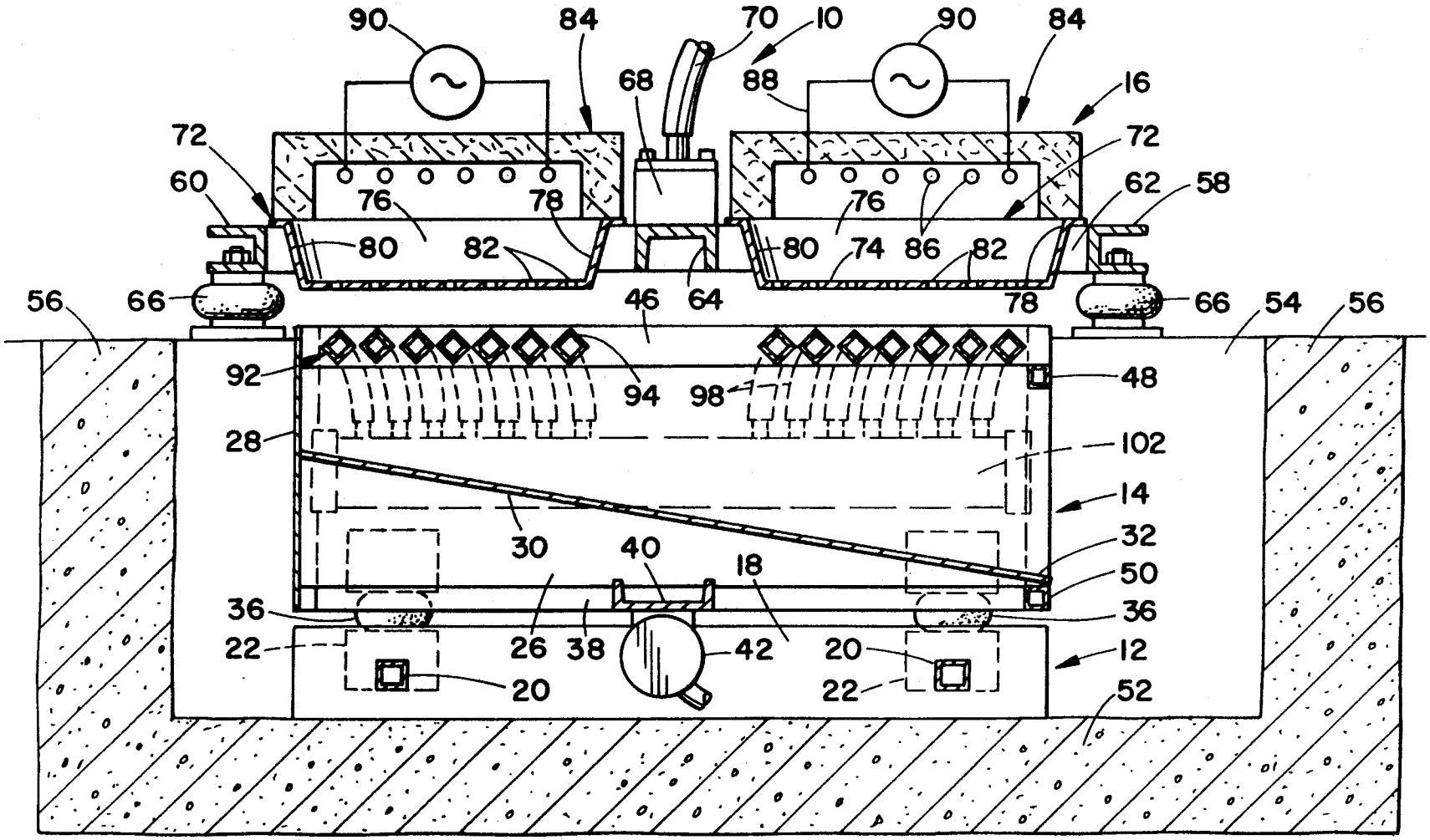
FIG. 4 is a sectional elevation view of the apparatus taken along line 4—4 in FIG. 3; and, FIG. 5 is a perspective view of a piece of shot produced by the apparatus.

From the foregoing description of the structure of the apparatus, it is believed that the following description of the operation thereof to produce metal shot will be readily understood. Assuming the pan assembly 16 and the deflector and conveyor assembly 14 to be vibrating through the operation of the vibratory devices 68 and 42, respectively, and assuming that coolant is being circulated through deflector members 92, that heating elements 54 are energized and that molten metal has been poured into pans 72, vertical vibration of pans 72 cause molten metal to flow downwardly through openings 82 in the bottoms of the pans. The vibration of the pans interrupts the flow through openings 82, thus forming spherical droplets of molten metal which descend vertically through air along a first air cooling path defined by the distance between the bottoms of the pans and surfaces 94 of the deflector members 92. The droplets are initially cooled as they descend along the corresponding air path, and the droplets are further cooled and solidify upon impacting against upper surface 94 of the corresponding deflector member 92. Moreover, upon impacting against surface 94 the droplet is somewhat flattened from the initial spherical contour to a final contour in which the shot is generally round and somewhat flattened as shown in FIG. 5 in which the shot is designated by the letter S. Upper surfaces 94 of deflector members 92 interrupt the descent of the droplets and the droplets adhere to the surface momentarily to enhance further cooling and solidification thereof. Vibration of surfaces 94 breaks the adhesion, and the incline of upper surfaces 94 together with vibration thereof causes the shot to slide from the deflector surfaces, whereupon the shot descends vertically through air along a second or air cooling path and onto the surface of inclined conveyor surface 30. Shot S is further cooled as it descends along the second air path and, upon contacting conveyor surface 30, the shot is transferred downwardly therealong as a result of the incline of the surface and the vibratory motion imparted thereto by vibrator 42. The shot is further cooled during such transfer along the conveyor surface and upon reaching the lower or discharge end 32 of the conveyor surface is cooled sufficiently to preclude the shot adhering to one another. The shot can then be collected in a suitable receptacle at the discharge end 32, or suitably transported from the discharge end to another location such as by a conveyor.

It will be appreciated that the positioning of the deflector members 92 in a horizontal plane parallel to bottom walls 74 of pans 72 provides for the shot S to be generally uniform in contour and at the same temperature at the time of deflection thereof from surfaces 94 of the deflector members. It will be noted too that the inclined attitude of the conveyor surface relative to the plane of the deflector members provides for the second air cooling path to be progressively longer with respect to the direction from the upper end of the conveyor towards the lower end thereof, and that the path of travel of the shot along the conveyor surface progressively decreases with respect to the direction from the upper end of the conveyor towards the lower or discharge end thereof. These relationships provide for all of the shot to be cooled substantially to the same temperature upon reaching the discharge end of the conveyor plate.

It will be appreciated from the foregoing description that there are four distinct stages of cooling in connection with producing shot, namely air cooling during descent along the first air path, cooling upon impact with and adherence to cooled deflector members 92, air cooling during descent along the second air cooling path, and cooling during movement along the conveyor surface. It will be further appreciated that this cooling capability together with the number of pans and openings in the bottom walls thereof enables a high poundage per hour of shot to be produced with minimum space requirements for the apparatus.

The rate of production of shot in pounds per hour is dependent upon a number of factors including the number and size of openings 82 in each pan 72, the temperature of the molten metal, the frequency of vibration of the pans, and the number of pans being used. With regard to the latter, it will be appreciated that a single pan could be used and that more than two pans as disclosed herein could be used. One of the advantages of using a plurality of pans is the fact that the rate of production can be controlled by the selected use of one or more of the pans. A further advantage resides in the fact that a burn through in the bottom wall of one of the pans does not preclude production using the other pan or pans until the one pan can be replaced. Preferably, in connection with the production of aluminum shot, openings 82 in the pans have a diameter of 1/16 inch, and the molten metal is maintained at a temperature of between about 1300° F. and about 1350° F. The length of time that the molten metal droplets remain on then inclined surfaces 94 of deflector members 92 is dependent on the angle of the surface 94, the temperature of the latter as determined by the temperature of the coolant flow through the deflector members, and the rate of vibration of the deflector and conveyor assembly 14. Therefore, it will be appreciated that there is also a correlation between the latter and the rate of vibration of the vibrating pan assembly which controls the rate of discharge of molten metal droplets from the pans. Preferably, the coolant circulated through the deflector members 92 is maintained at a temperature between about 30° F. and about 60° F., preferably using a glycol to minimize rusting and corrosion, and the surfaces 94 of the deflector members are preferably inclined downwardly relative to horizontally at an angle of about 12°. As is standard, and known in the industry, the frequencies of vibration imparted by air vibrator 68 and electric vibrator 42 are adjustable whereby, with the foregoing parameters, the rates of vibration can be adjusted so that the droplets descending from the molten metal pans impinge on, solidify and depart from deflector surfaces 94 prior to impingement thereagainst by the succeeding series of droplets falling from the pans.

While considerable emphasis has been placed herein on the embodiment illustrated and described, it will be appreciated that many changes can be made in the embodiment disclosed and that other embodiments can be devised without departing from the principles of the present invention. In this respect, for example, the vibration supporting air bag components between the base and the deflector and conveyor assembly and between the vibratory pan assembly and the concrete pit could be replaced by spring elements. Further, the apparatus could be supported at floor level in which case a supporting frame structure above floor level would be provided for supporting the vibratory pan assembly. Still further, the supporting arrangement for the component parts of the apparatus could be such that the pan assembly and deflector members would be vibrated by a common vibrating mechanism and in the embodiment disclosed, the conveying surface and deflector members could be vibrated independent of one another. While it is preferred to vibrate the inclined conveyor surface to enhance continuous movement of the shot toward the discharge end thereof, it will be appreciated that such continuous movement can be obtained without vibration by increasing the angle of incline of the conveying surface, or through the use of a driven belt type conveyor. Vibration of the inclined conveyor surface is preferred because it affords better control of the rate and uniformity of movement of shot toward the discharge end than would a non-vibrated inclined surface, and avoids the costs of installation and maintenance attendant to using a belt type conveyor. These and other modifications of the disclosed embodiment as well as other embodiments of the invention will be suggested and obvious to those skilled in the art upon reading the foregoing description, whereby it is to be distinctly understood that the foregoing descriptive matter is to be interpreted merely as illustrative of the invention and not as a limitation.

Having thus described the invention, it is claimed:

1. Apparatus for making metal shot comprising container means for molten metal, said container means including bottom wall means having a plurality of parallel and spaced apart rows of openings therethrough, deflector means for each said row openings, each said deflector means vertically underlying the corresponding row of openings and including surface means extending in the direction of said corresponding row and disposed at an angle to horizontal, means for cooling said deflector means, means for vibrating said container means and said deflector means, and conveyor means underlying said deflector means, said container means having longitudinally opposite ends and laterally opposite sides, said rows of openings extending in the direction between said sides and being spaced apart in the direction between said ends, each said deflector means including a deflector member extending in the direction between said opposite sides, each said deflector member including a planar surface extending in the direction between said opposite sides and inclined in the direction between said opposite ends, each said deflector member being tubular in cross section, and said means for cooling said deflector means including means to flow cooling fluid through each said deflector member, said conveyor means including conveyor surface means extending in the direction between said opposite ends of said container means, said conveyor surface means being planar and inclined in the direction between said opposite ends of said container means, means to vibrate said conveyor surface means, said means to vibrate said container means and said deflector means including first vibrating means to vibrate said container means and second vibrating means to vibrate said deflector means, said second vibrating means providing said means to vibrate said conveyor surface means, means to heat said container means, said planar surface of each said deflector member and said planar conveyor surface means being inclined in the same direction relative to said opposite ends of said container means, each said deflector member having opposite ends corresponding to said opposite sides of said container means, and said means to flow cooling fluid through said deflector member including inlet conduit means connected in flow communication with each said deflector member at one of said opposite ends thereof and outlet conduit means connected in flow communication with each said deflector member at the other of said opposite ends thereof.

* * * * *